US008413842B1

(12) United States Patent
Clou

(10) Patent No.: US 8,413,842 B1
(45) Date of Patent: Apr. 9, 2013

(54) GLOVE INCORPORATING ANIMAL WASTE BAGS AND TIES FOR COLLECTING, PACKAGING AND DISPOSING OF ANIMAL WASTE

(76) Inventor: Jean Clou, Las Vegas, NV (US)

( * ) Notice: Subject to any disclaimer, the term of this patent is extended or adjusted under 35 U.S.C. 154(b) by 0 days.

(21) Appl. No.: 13/444,758

(22) Filed: Apr. 11, 2012

(51) Int. Cl.
*B65H 1/00* (2006.01)

(52) U.S. Cl.
USPC ..... 221/34; 221/129; 2/159

(58) Field of Classification Search ..... 221/34, 221/102; 222/129; 294/1.3
See application file for complete search history.

(56) References Cited

U.S. PATENT DOCUMENTS 4,805,242 A * 2/1989 Bolton ..... 2/160
4,850,486 A * 7/1989 Neibaur ..... 221/45
5,003,637 A * 4/1991 Lonon ..... 2/160
5,358,141 A * 10/1994 Carlson et al. ..... 221/185
5,642,810 A * 7/1997 Warner et al. ..... 206/389
6,511,111 B2 1/2003 Dooley
7,735,682 B1 * 6/2010 Cassel et al. ..... 221/185
2004/0172735 A1 9/2004 Garland
2005/0052037 A1 3/2005 Spuck
2008/0174128 A1 7/2008 Jezzi

FOREIGN PATENT DOCUMENTS

FR 2957096 9/2011

* cited by examiner

*Primary Examiner* — Timothy Waggoner
(74) *Attorney, Agent, or Firm* — Greenberg Traurig

(57) ABSTRACT

A glove incorporating a roll of waste bags and ties on a rotatable spool contained within a pocket integrated on a palm side of the glove. The spool pocket is proximate a pathway having a first and second opening through which the waste bags may be individually pulled and removed from the spool for utilization as a package for solid animal waste. The ties may extend through the pathway or may extend through an opening in the pocket for access by a user.

12 Claims, 4 Drawing Sheets

FIG. 3A
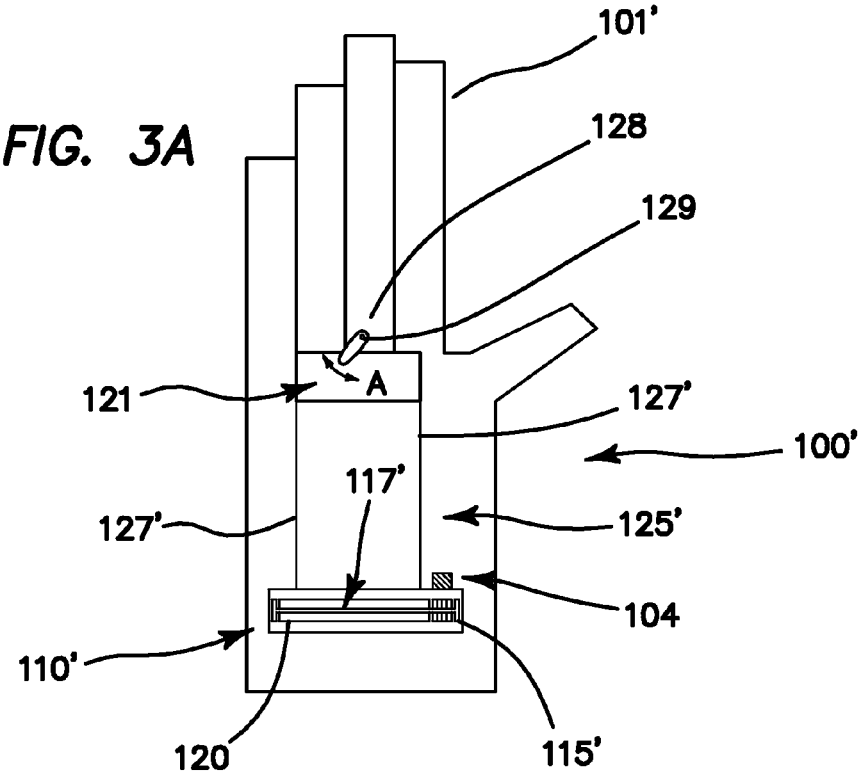
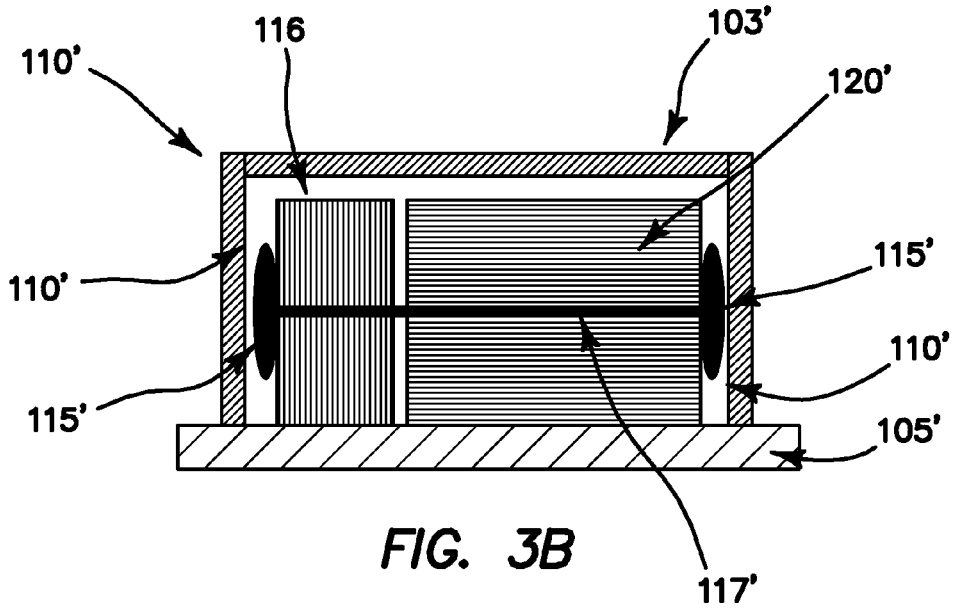
FIG. 3B

GLOVE INCORPORATING ANIMAL WASTE BAGS AND TIES FOR COLLECTING, PACKAGING AND DISPOSING OF ANIMAL WASTE

FIELD OF THE INVENTION

The embodiments of the present invention relate to a glove incorporating waste bags and ties providing animal walkers a mechanism for collecting, packaging and disposing of animal waste.

BACKGROUND

Thirty-nine percent of U.S. homes own at least one dog and there are approximately seventy-eight million dogs in the United States. Dogs are normally taken outside by their owners to defecate and, in most instances, owners clean up the resultant solid waste by placing it in a small plastic bag which is tied off and disposed of. However, there are many occasions when owners forget the plastic bag or other wise find them unavailable. Under such circumstances, owners may purposefully or unavoidably not clean up the solid waste thereby creating an unsightly and unsanitary situation.

Therefore, it would be beneficial to ensure that dog owners have a plastic bag available to collect, package and dispose of animal waste at the appropriate time. Advantageously, the embodiments of the present invention involve a glove incorporating waste bags and ties for such purposes. The glove not only incorporates the waste bags and ties but also a mechanism for attaching the glove to a leash or collar thereby ensuring that the glove, waste bags and ties are available for the dog owner when needed.

SUMMARY

The embodiments of the present invention relate to a glove incorporating, in one embodiment, a roll of waste bags and ties on a rotatable spool contained within a spool pocket integrated on a palm side of the glove. The spool pocket is proximate a pathway having a first and second opening through which the waste bags may be individually pulled and removed from the spool for utilization as a package for solid animal waste.

To provide assurance that the glove is available when needed, the glove includes a clip, clasp, carabiner or other attachment mechanism for attaching the glove to a collar or leash.

Other variations, embodiments and features of the present invention will become evident from the following detailed description, drawings and claims.

BRIEF DESCRIPTION OF THE DRAWINGS

FIG. 3*a* illustrates a palm side view of a glove according to the second embodiment of the present invention;

FIG. 3*b* illustrates a cross-sectional view of a second embodiment of a waste bag spool according to the embodiments of the present invention.

DETAILED DESCRIPTION

Figure 1A:
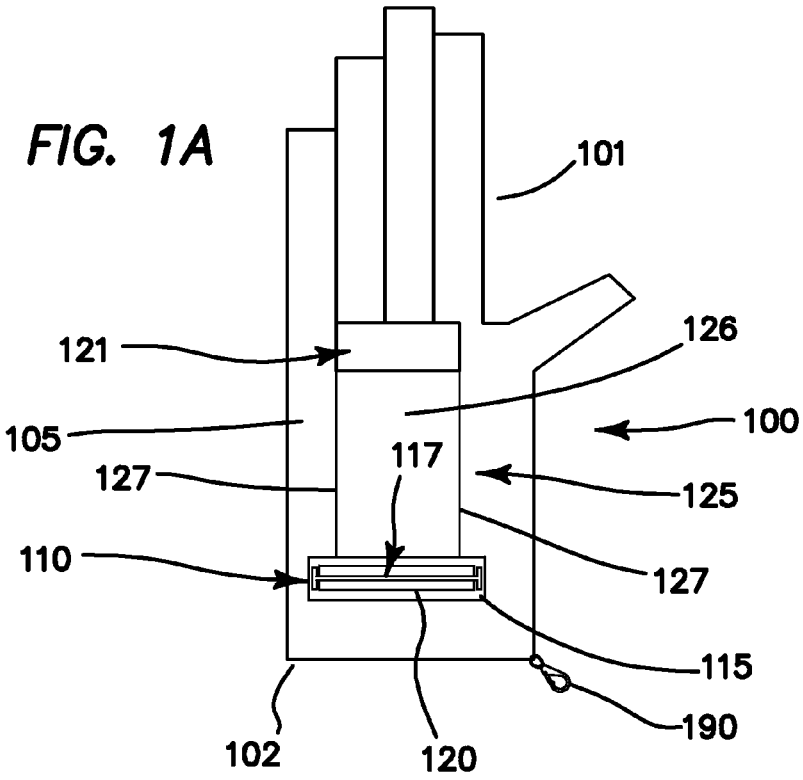
FIGS. 1*a*-1*b* illustrate palm side views of a glove according to a first glove configuration the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The glove 100 described herein maybe made of any suitable materials including fabric, latex, plastics, and the like. In one embodiment, the glove fingers 101 are fabricated of a thick, insulating flexible material to minimize the user's tactile experience with the solid animal waste. As used herein, the term glove 100 includes a fingerless glove and mitten.

Figure 1B:
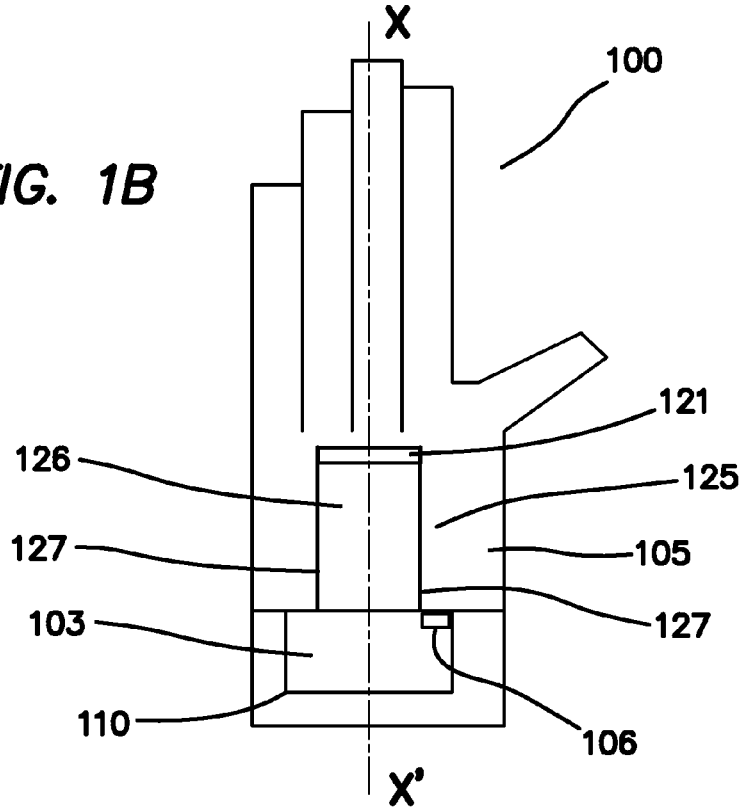

FIGS. 1*a*-1*b* show a glove 100 comprising a top side, palm side 105, finger extensions 101 and opening 102 for insertion of a hand. A spool pocket 110, shown in an open position in FIG. 1*a*, and closed position in FIG. 1*b*, contains a spool 115 holding a roll of bags 120. Spool 115 includes a spool shaft 117. A flap 103 is configured to conceal and provide access to said spool 115. The flap 103 includes hook and loop fasteners, buttons, clasps and the like allow the flap 103 to open and close to access to the spool 115. The roll of bags 120 is formed of bags joined to one another with perforated arrangement allowing individual bags to be removed as needed. A conduit or pathway 125 is positioned proximate to the spool pocket 110 through which one or more bags of the roll of bags 120 extends from said spool 115 proximate a palm of a hand through a first opening 109 to a second opening 130 proximate the finger extensions 101. A bag 121 is shown extending partially from said opening 130. The spool 115, based on the tightness of the pocket 110 and the width of the pathway 125, which is smaller than the length of the spool 115, rotates in place, within the pocket 110, when a user pulls on the bag extending through pathway 125. That is, the spool 115 is held in place within the pocket 110 and does not easily exit the pocket 110 when the bags 120 are pulled. However, the user may actively remove the spool 115 for replacement or repair.

The pathway 125 is defined by glove material proximate the palm of a user when worn and a secondary piece of rectangular material 126 sewn along a pair of edges 127 or otherwise affixed to the palm side 105 of the glove 100. The secondary piece of material 126 may be the same material used to fabricate the glove 100 or any other material which may be affixed to the palm side 105 of the glove 100. It is understood that the spool 115 may be positioned proximate the finger extensions 101 such that the bags are removed via a pathway opening proximate the palm of a user.

Figure 2A:
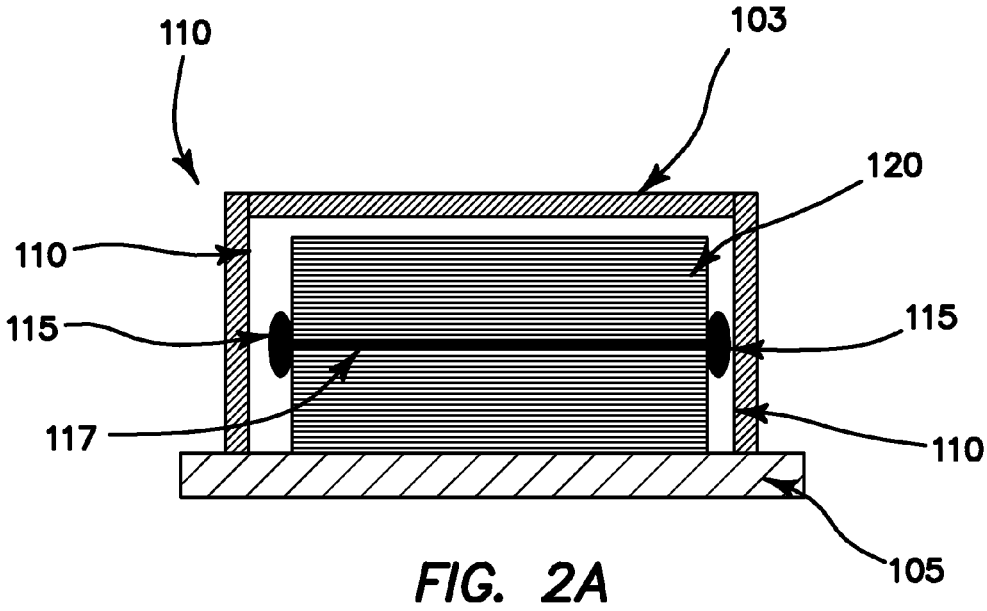
FIGS. 2*a* and 2*b* illustrate cross-sectional front and side views of a spool maintained by the glove according to the embodiments of the present invention.
Figure 2B:
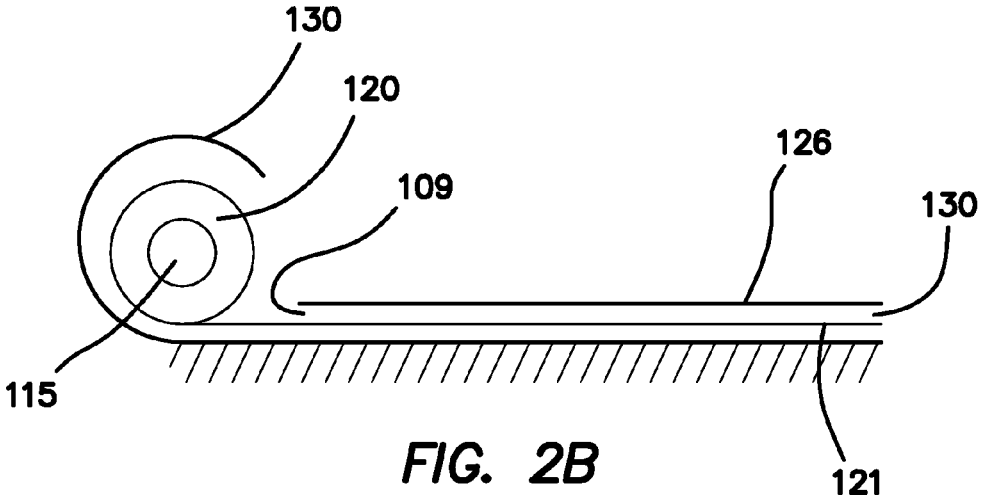

FIGS. 2*a* and 2*b* (along x-x') show cross-sectional front and side views, respectively, of the spool 115 held in place within spool pocket 110 such that when the bag 121 is pulled through said pathway 125, the spool 115 rotates freely within the spool pocket 110 on the palm side 105 of the glove 100. Again, when the roll of bags 120 is depleted, it is removed and replaced with a new spool and roll of bags.

FIG. 3*a* shows a palm side view of a glove 100' according to a second embodiment of the present invention. In this embodiment, like glove 100, the spool pocket 110', flap 103' and palm 105' contain spool 115' which maintains a roll of bags 120' and proximate roll of ties 116. The spool 115' includes spool shaft 117'. FIG. 3*b* shows a front cross-sectional view of the spool 115' holding a roll of bags 120' and roll of ties 116 adjacent thereto according to a second embodiment of the present invention. The roll of bags 120' and roll of ties 116 may move independently or dependently about a common spool shaft 117'. Alternatively, the spool shaft 117', roll of bags 120' and ties 116 move together (that is, the roll of bags 120' and ties 116 do not spin around the shaft 117). The roll of ties 116 may comprise perforated or non-perforated lengths of film, string, elastic or any other material capable of being used to tie a bag. In one embodiment, the ties 116 do not pass through the pathway 125' but rather are accessed via an opening 104 adjacent or in the flap 103'. Alternatively, the ties 116, like the bags, may be feed through the pathway 125' and accessed at the second opening 130' or directly from the pocket 110' when flap 103' is open.

Figure 4:
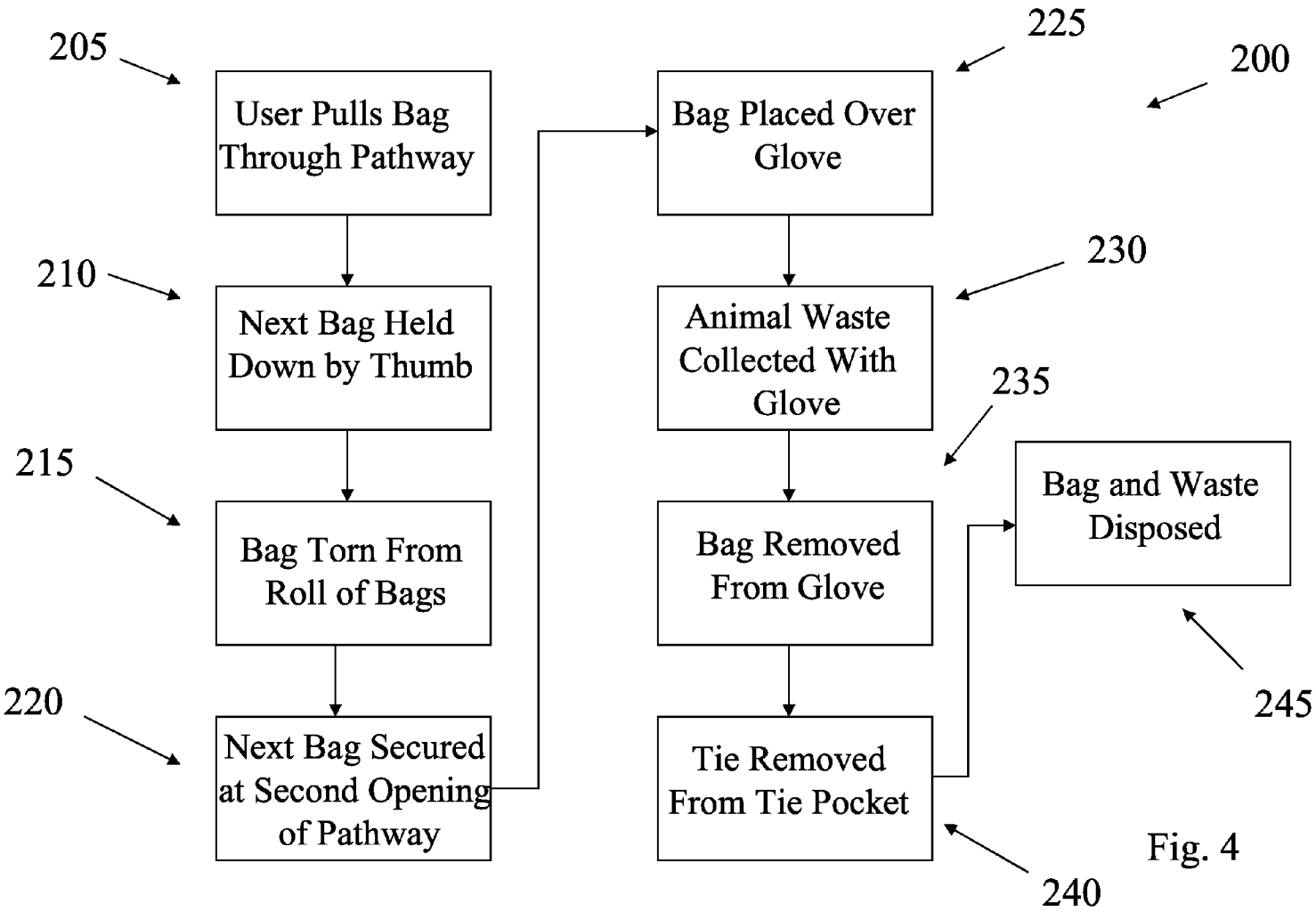
FIG. 4 illustrates a flow chart detailing a method of using the glove according to the embodiments of the present invention.

FIG. 4 shows a flow chart 200 detailing a method of using the glove 100 described herein. At 205, a user pulls a bag, such as bag 121, from the second opening 130 until the bag is clear of the opening 130. At 210, the user uses his or her thumb to secure a next bag within the pathway 125 by pressing down on the secondary piece of material 126 of the pathway 125. At 215, the user tears the bag 121 from the roll of bags 120 along a perforated edge. At 220, the user clips a next bag to prevent the next bag from returning into the pathway. At 225, the bag 121 is placed over the glove 100. At 230, the solid animal waste is collected using the bag-covered glove 100. At 235, the bag 121 is removed from the glove 100 open end first thereby containing the solid animal waste in the bag 121. At 240, a tie is removed from said spool pocket 115 and used to close said bag 121. At 245, the bag 121 and contained solid animal waste are disposed of.

As shown in FIG. 1*a*, the glove 100 may also include an attachment mechanism 190 such as a clip, clasp, carabiner or similar item for attaching the glove 100 to a pet collar or leash. In this manner, the glove 100 is available when needed (i.e., while the dog owner is walking the dog or talking the dog outside). A clip or similar item may also be positioned to hold the bag 121 extending from the second opening 130 to prevent the bag 121 from returning into the pathway 125. In this manner, the bag 121 is easily and conveniently ready for dispensing. FIG. 3*a* shows an exemplary adjustable member 128 which may be rotated about a fixed point 129, as referenced by letter A, to secure and release the bag 121. A clip or other mechanism may also maintain the bag 121 in place.

Although the invention has been described in detail with reference to several embodiments, additional variations and modifications exist within the scope and spirit of the invention as described and defined in the following claims.

I claim:

1. A glove comprising:

a palm side, top side and opening for insertion of a hand;

a spool holding a roll of waste bags and ties side-by-side, said spool incorporated in a spool pocket on said palm side;

a pathway comprising a first opening proximate said spool and a second opening; and wherein one or more bags of said roll of waste bags extend through said pathway from said spool to said second opening allowing a bag to be accessed by a user.

2. The glove of claim 1 further comprising a flap closure associated with said spool pocket.

3. The glove of claim 1 further comprising means for securing a bag extending from said second opening to prevent said bag from returning into said pathway.

4. The glove of claim 2 further comprising an opening in said flap for accessing said ties.

5. The glove of claim 1 further comprising means for attaching said glove to an article.

6. A glove comprising:

a palm side, top side, fingers and opening for insertion of a hand;

a spool rotatably arranged in a pocket on said palm side, said spool maintaining a roll of waste bags and ties;

a pathway comprising a first opening proximate said spool and a second opening spaced therefrom; and wherein bags of said roll of bags pass through said pathway for access by a user at a second opening thereof.

7. The glove of claim 6 further comprising a flap closure associated with said spool pocket.

8. The glove of claim 6 further comprising means for securing a bag extending from said second opening to prevent said bag from returning into said pathway.

9. The glove of claim 7 further comprising an opening in said flap for accessing said ties.

10. The glove of claim 7 further comprising means for attaching said glove to an article.

11. A glove comprising:

a palm side, top side, fingers and opening for insertion of a hand;

a spool maintaining a roll of waste bags and ties, said spool in a pocket on said palm side;

a pathway comprising a first opening proximate said spool and a second opening spaced therefrom;

a device for securing a bag extending from said second opening to prevent said bag from returning into said pathway; and wherein bags of said roll of bags pass through said pathway for access by a user at a second opening thereof and said ties are accessible from said pocket.

12. The glove of claim 11 further comprising means for attaching said glove to an article.

* * * * *